US011208280B2

(12) United States Patent
Briggs et al.

(10) Patent No.: US 11,208,280 B2
(45) Date of Patent: Dec. 28, 2021

(54) TAPE HOLDER

(71) Applicants: Timothy Briggs, Newnan, GA (US); Ginger Briggs, Newnan, GA (US)

(72) Inventors: Timothy Briggs, Newnan, GA (US); Ginger Briggs, Newnan, GA (US)

( * ) Notice: Subject to any disclaimer, the term of this patent is extended or adjusted under 35 U.S.C. 154(b) by 0 days.

(21) Appl. No.: 16/361,201

(22) Filed: Mar. 21, 2019

(65) Prior Publication Data

US 2019/0337746 A1 Nov. 7, 2019

Related U.S. Application Data

(63) Continuation-in-part of application No. 14/504,483, filed on Oct. 2, 2014, now Pat. No. 10,435,268.

(60) Provisional application No. 62/646,269, filed on Mar. 21, 2018.

(51) Int. Cl.

| | |
|---|---|
| ***B65H 16/02*** | (2006.01) |
| ***B65H 49/20*** | (2006.01) |
| ***B65H 49/32*** | (2006.01) |
| ***B65H 75/10*** | (2006.01) |
| ***B65H 54/54*** | (2006.01) |

(52) U.S. Cl.

CPC ..... *B65H 16/02* (2013.01); *B65H 49/205* (2013.01); *B65H 49/327* (2013.01); *B65H 54/54* (2013.01); *B65H 75/10* (2013.01); *B65H 2401/213* (2013.01); *B65H 2701/377* (2013.01); *B65H 2701/526* (2013.01)

(58) Field of Classification Search

CPC ..... B65H 16/02; B65H 75/10; B65H 54/54; B65H 49/205; B65H 49/327; B65H 2401/213; B65H 2701/526; B65H 2701/377

See application file for complete search history.

(56) References Cited

U.S. PATENT DOCUMENTS

| | | | | | |
|---|---|---|---|---|---|
| 1,818,514 | A * | 8/1931 | Whitaker | B65H 75/22 | 224/162 |
| 2,640,656 | A * | 6/1953 | Donkin | B65H 35/0026 | 225/25 |
| 3,155,301 | A * | 11/1964 | Kusek | B65H 35/0026 | 225/66 |
| 3,971,280 | A * | 7/1976 | Inka | B26D 1/385 | 83/436.9 |
| D263,505 | S * | 3/1982 | Black | 206/63.3 | |
| 4,832,282 | A * | 5/1989 | Koike | B65H 49/20 | 242/129.72 |
| 4,946,115 | A * | 8/1990 | Muller | A01K 89/016 | 188/267 |
| 5,011,447 | A * | 4/1991 | Watanabe | A63H 27/10 | 242/396.5 |
| 5,131,534 | A * | 7/1992 | Brown | A61B 17/06123 | 206/339 |
| 5,641,109 | A * | 6/1997 | Willoughby | B65H 35/0026 | 224/162 |
| 6,085,955 | A * | 7/2000 | Hicks | B65H 35/0026 | 225/42 |
| 6,216,978 | B1 * | 4/2001 | Rodriguez | E04F 21/00 | 242/588.1 |

(Continued)

FOREIGN PATENT DOCUMENTS

| | | | | |
|---|---|---|---|---|
| GB | 673055 | * | 5/1952 | B65H 35/0026 |

*Primary Examiner* — William A. Rivera
(74) *Attorney, Agent, or Firm* — Charlena Thorpe, Esq.; Incorporating Innovation LLC

(57) ABSTRACT

Implementations of a tape holder are provided. In some implementations, the tape holder may be used to secure a roll of tape to a magnetic surface. In some implementations, the tape holder is comprised of a base member and a spool support.

15 Claims, 7 Drawing Sheets

(56) References Cited

U.S. PATENT DOCUMENTS

| | | | | |
|---|---|---|---|---|
| 6,328,246 | B1 * | 12/2001 | Hjort | A47K 10/3836 242/422.5 |
| 6,672,532 | B1 * | 1/2004 | Huang | B65H 35/0026 225/65 |
| 2003/0098384 | A1 * | 5/2003 | Black | A47K 10/3836 242/588.2 |
| 2003/0197084 | A1 * | 10/2003 | Anderson | A63H 27/002 242/402 |
| 2007/0158017 | A1 * | 7/2007 | Rice | B65H 35/0033 156/253 |
| 2007/0267148 | A1 * | 11/2007 | Steele | B65H 35/0026 156/577 |
| 2016/0311637 | A1 * | 10/2016 | Stenavich | B65H 16/005 |

* cited by examiner

TAPE HOLDER

CROSS REFERENCE TO RELATED APPLICATION

This application is a continuation-in-part of currently pending U.S. application Ser. No. 14/504,483, filed on Oct. 2, 2014, which claims the benefit of U.S. Provisional Application No. 61/930,597, filed on Jan. 23, 2014, and this application also claims the benefit of U.S. Provisional Application No. 62/646,269, filed on Mar. 21, 2018, each of which foregoing application is incorporated herein by reference in its entirety.

TECHNICAL FIELD

This disclosure relates to implementations of a tape holder.

BACKGROUND

Masking tape is frequently used while painting to protect surfaces not intended to be painted. Painters often find it desirable to keep a roll of masking, or similar tape, nearby while painting. However, finding a convenient place to securely store the roll of tape when not in use can be difficult. For example, in body shops, masking tape is often used. However, there is no convenient place to put the tape when not in use.

DETAILED DESCRIPTION

Implementations of a tape holder are provided. In some implementations, the tape holder may be used to secure a roll of tape to a magnetic surface.

In some implementations, the tape holder comprises a base member and a spool support. In some implementations, the base member has one or more magnets on one side for securing the tape holder to a surface. In some implementations, the spool support is configured to secure a roll of tape to the tape holder. In some implementations, the spool support is configured to receive a roll of tape thereon.

In some implementations, the spool support may include one or more flexible members thereon configured to releasably secure a roll of tape on the spool support. In some implementations, the flexible member is a movable portion of the spool support.

In some implementations, a flexible member may include a lip on its distal end thereby forming a ledge on a portion of the top of the spool support. In use, the lip may overlap the edge of a roll of tape and assist in securing the roll of tape about the spool support. In some implementations, a lip may include a chamfer and/or radius thereon. The chamfer and/or radius may ease inserting the spool support into the interior opening of a roll of tape.

In some implementations, the base member may include three cut-outs. In some implementations, each of the cut-outs may be configured to extend under at least a portion of a roll of tape secured about the spool. In this way, a user may more easily grasp and pull against the bottom of a roll of tape when removing it from the spool of the tap holder.

In some implementations, the tape holder may include a bearing shelf. In some implementations, the bearing shelf may be configured to support a roll of tape thereon. In some implementations, the bearing shelf may be configured so that the edge of a roll of tape secured about the spool support is supported thereon. In this way, the tape portion of a roll of tape may be prevented from rubbing against the base member.

Figure 1A:
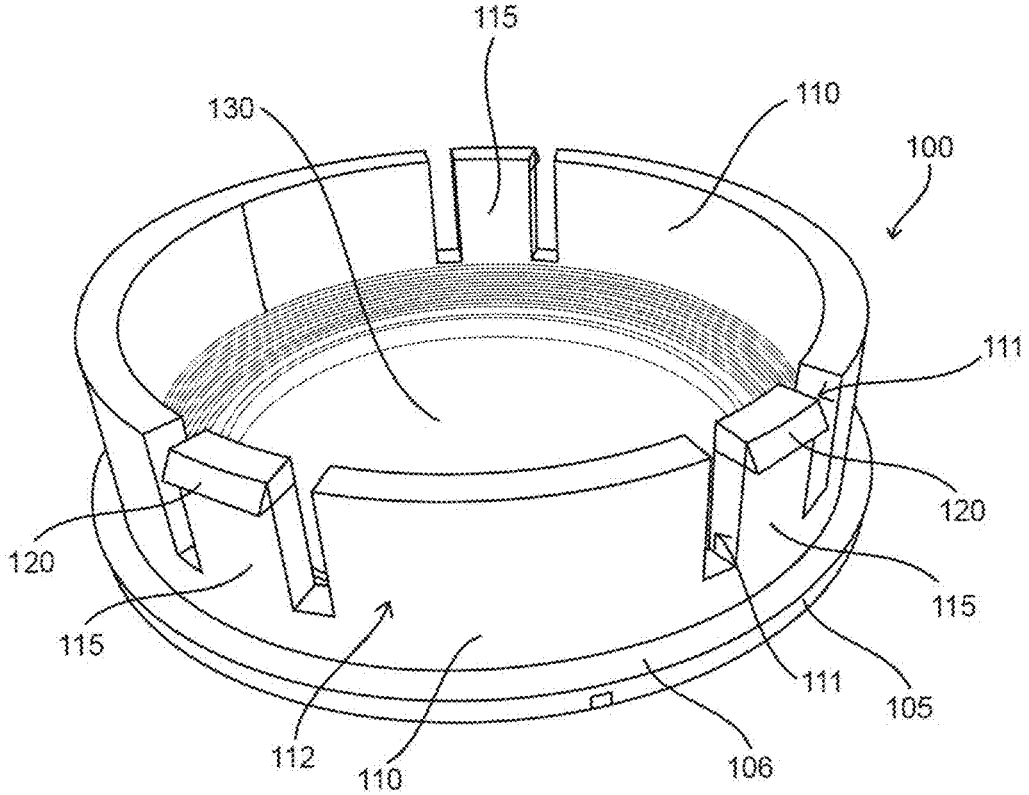
FIGS. 1A and 1B illustrate an example tape holder for securing a roll of tape to a surface according to the present disclosure.
Figure 1B:
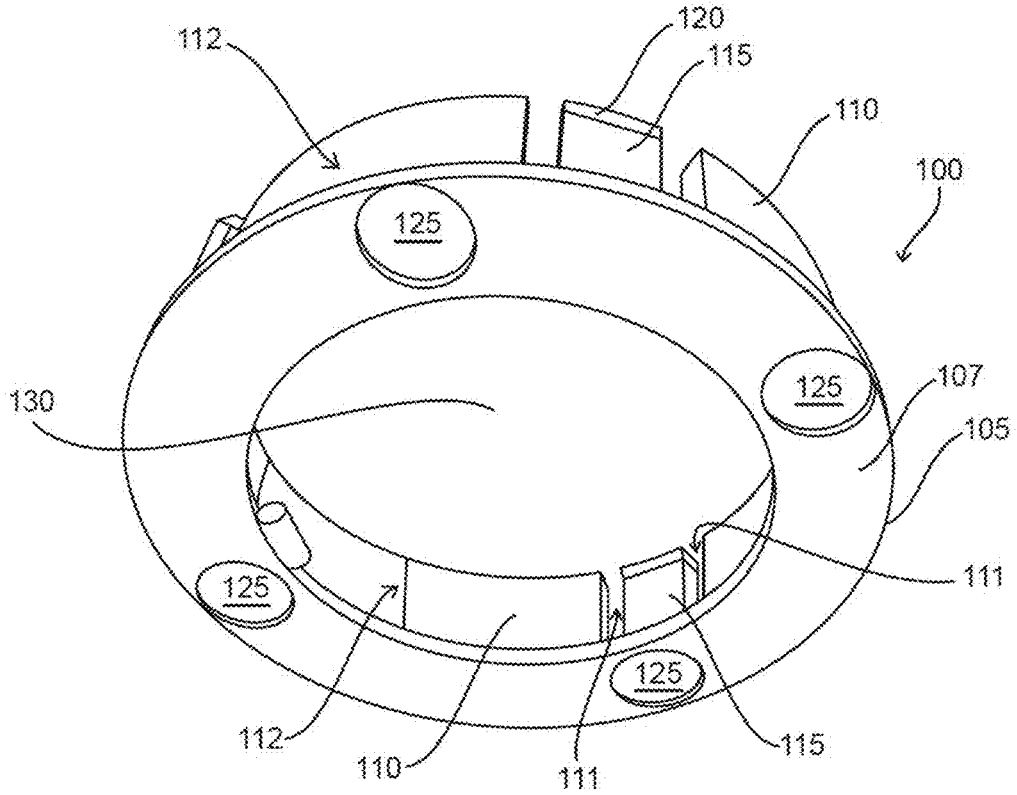

FIGS. 1A and 1B illustrate an example tape holder 100 for securing a roll of tape to a surface according to the present disclosure.

As shown in FIGS. 1A and 1B, in some implementations, the tape holder 100 is comprised of a base member 105 and a spool support 110. In some implementations, the base member 105 has one or more magnets on one side for securing the tape holder 100 to a surface. In some implementations, the spool support 110 is configured to secure a roll of tape to the tape holder 100.

In some implementations, the tape holder 100 is constructed with an opening 130 extending through a portion of the base member 105 and spool support 110. In this way, users can insert their fingers through the opening 130 to hold the tape holder 100.

As shown in FIG. 1B, in some implementations, the base member 105 may be flat and have a generally circular shape. In some implementations, the base member 105 may be any other suitable shape.

In some implementations, the base member 105 may have a top side 107 and a bottom side 106. In some implementations, the top side 107 of the base member 105 may include one or more recesses 125 thereon to receive a magnet therein. In some implementations, the top side 107 may include four recesses as shown in FIG. 1B. In some implementations, the top side 107 may include more than four recesses 125 thereon.

In some implementations, a recess 125 is round. In some implementations, a recess 125 may be any suitable shape. In some implementations, an adhesive is used to secure a magnet into a recess 125. In some implementations, any suitable means may be used to secure a magnet within a recess 125. In some implementations, the magnetics can be covered with an anti-skid material. In some implementations, the magnetics can be located within the interior of the base member 105.

In some implementations, the spool support 110 may be defined by a wall 112 having a circular shape.

In some implementations, one side of the spool support 110 may be attached to the bottom side 106 of the base member 105. As shown in FIG. 1A, in some implementations, the diameter of the base member 105 is larger than the diameter of the spool support 110. In this way, when the spool support 110 rest on top of the bottom side 106 of the base member 105, a portion of the bottom side 106 extends from the spool support 110 thereby creating a ledge around the tape holder 100. In some implementations, the spool support 110 may be integrally formed as part of the base member 105. In some implementations, the spool support 110 may be removably attached to the base member 105.

In some implementations, the wall 112 of the spool support 110 may be configured to allow a roll of tape to rotate smoothly thereabout. In some implementations, the wall 112 of the spool support 110 may be configured to restrict the rotation of a roll of tape.

In some implementations, the spool support 110 may include one or more flexible members 115 thereon configured to releasably secure a roll of tape on the spool support 110. In some implementations, the flexible member 115 is a movable portion of the spool support 110. In some implementations, a flexible member 115 may be formed by a pair of cutouts 111 a predefined distant apart through portions of the wall 112 of the spool support 110.

In some implementations, a flexible member 115 may include a lip 120 on its distal end thereby forming a ledge on a portion of the top of the spool support 110. In use, the lip 120 may overlap the edge of a roll of tape and assist in securing the roll of tape about the spool support 110. As shown in FIG. 1A, in some implementations, a lip 120 may include a chamfer thereon. The chamfer may ease inserting the spool support 110 into the interior opening of a roll of tape or vise-versa.

In some implementations, the spool support 110 may include three flexible members 115. In some implementations, the spool support 110 may include more than three or less than three flexible members 115.

Figure 2A:
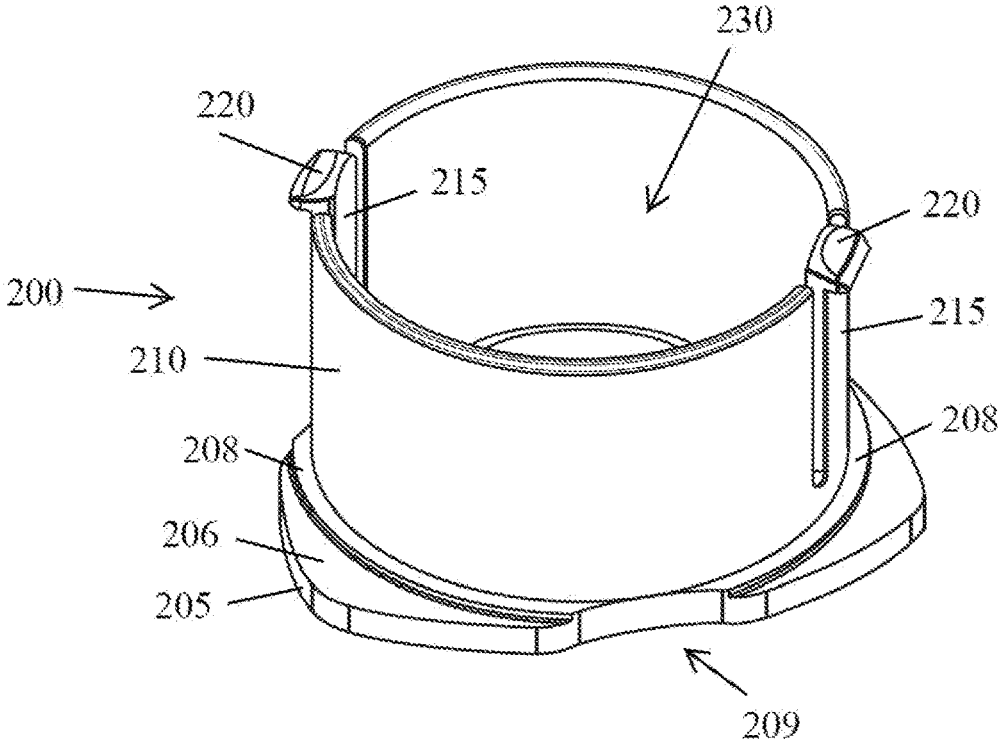
FIGS. 2A and 2B illustrate another example implementation of a tape holder constructed in accordance with the present disclosure.
Figure 2B:
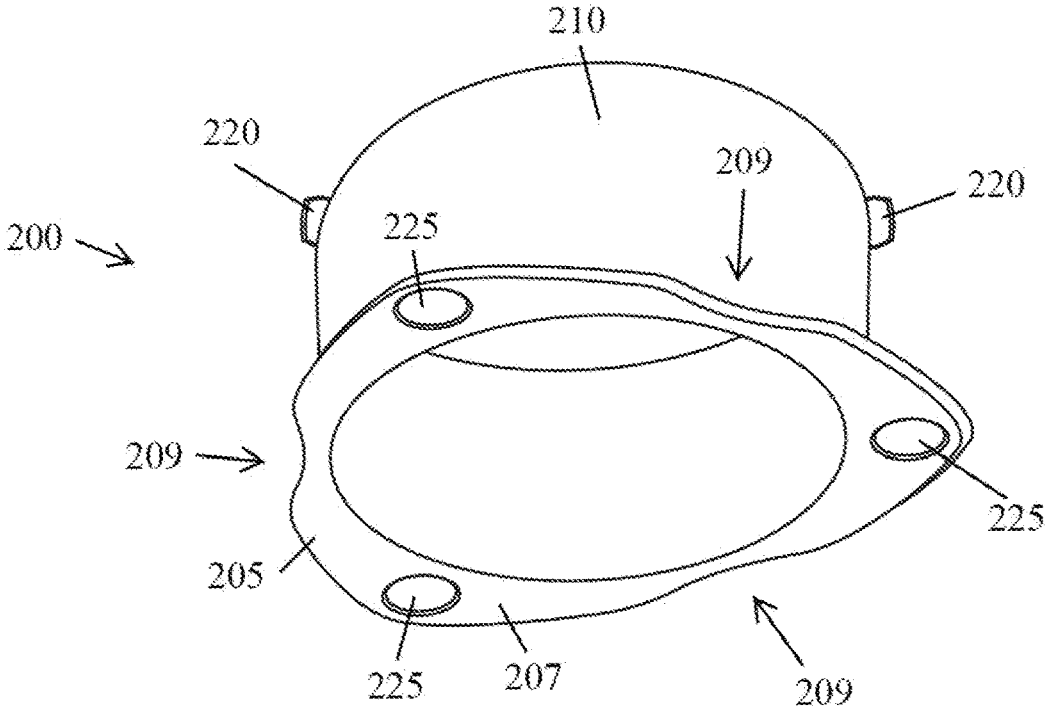
Figure 3:
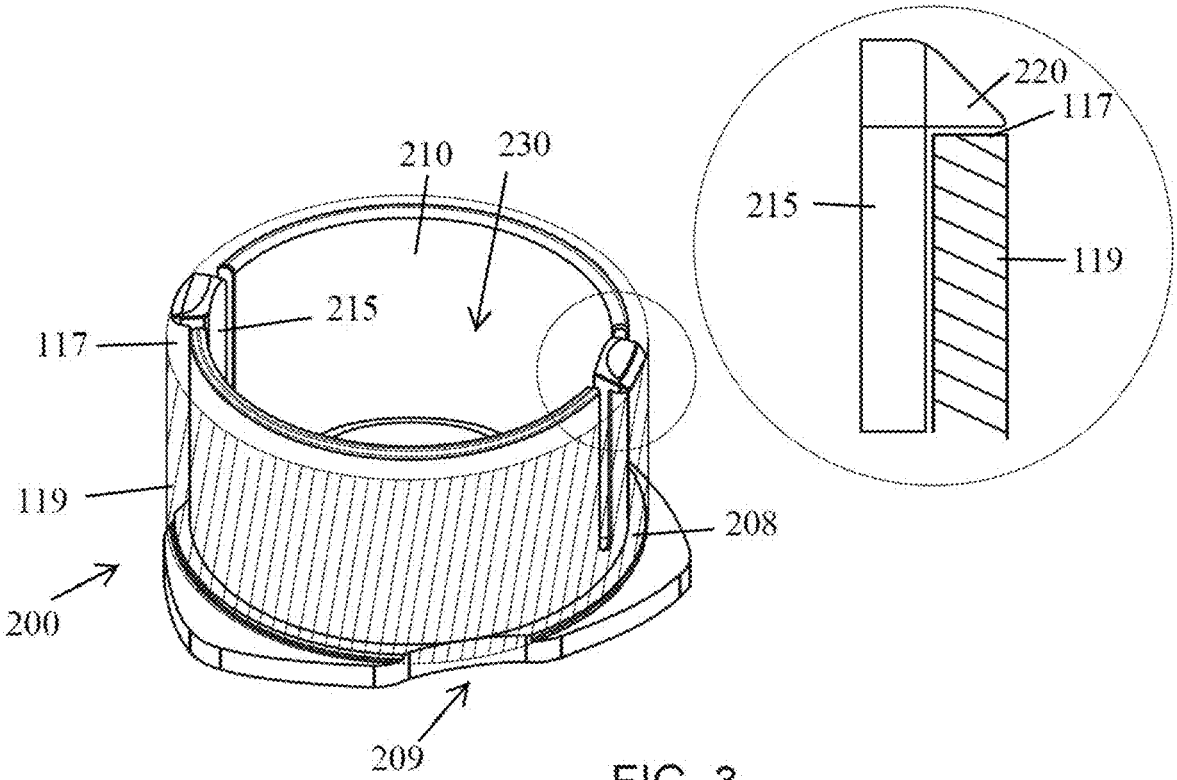
FIG. 3 illustrates the tape holder shown in FIG. 2A with a roll of tape secured thereon.

FIGS. 2A, 2B, and 3 illustrate another example implementation of a tape holder 200 of the present disclosure. In some implementations, the tape holder 200 is similar to the tape holder 100 discussed above but may include two flexible members 215, a flat base member 205 having the general shape of a triangle, a bearing shelf 208, and/or one or more cut-outs 209 extending into the base member 205 and bearing shelf 208. In some implementations, the top side 207 of the base member 205 may include three recesses 225.

In some implementations, the bearing shelf 208 may be positioned above the bottom side 206 of the base member 205. In some implementations, the bearing shelf 208 may extend from the spool support 210 thereby creating a ledge around the spool support 210 to support a roll of tape. As shown in FIG. 3, in some implementations, the bearing shelf 208 may be configured so that the edge 117 on one side of a roll of tape 119 secured about the spool support 210 is supported thereon. In this way, the tape portion of a roll of tape 119 may be prevented from rubbing against the base member 205. In some implementations, the bearing shelf 208 may also keep the one side of the roll of tape 119 free from dirt. In some implementations, the bearing shelf 208 may be circular. In some implementations, the bearing shelf 208 may be any suitable shape.

As shown in FIG. 3, in some implementations, each of the cut-outs 209 may be configured to extend under at least a portion of a roll of tape secured about the spool 210 thereby exposing a portion of the roll of tape. In this way, a user may grasp the bottom of a roll of tape to more easily remove it from the spool 210 of the tap holder 200. In some implementations, the base member 205 may include three cut-outs (as shown in FIG. 3) or more than three or less than three cut-outs 209 thereon.

In some implementations, the cut-outs 209 may be formed through an injection molding process. In some implementations, the cut-outs 209 may be formed by removing a portion of the base member 205 and/or the bearing shelf 208. In some implementations, the cut-outs 209 may be formed by any method currently known to, or developed in the future by, one of ordinary skill in the art.

As shown in FIG. 3, to secure a roll of tape onto some implementations of the tape holder, the spool support 210 may be initially inserted into the interior opening of a roll of tape. The edge 117 of the roll of tape 119 will compress the flexible members 215 toward the interior opening 230 of the tape holder 200 as the roll of tape is slide down the length of the spool support 210. A first side of the roll of tape 119 will come to rest against the bearing shelf 208 extending from the spool support 210. In this way, the tape portion located on the first side of the roll of tape 119 may be protected from contamination (e.g. dirt and debris). In some implementations, where there is no bearing shelf, the first side of the roll of tape 119 may come to rest against bottom side 206 of the base member 205 (see, e.g., FIG. 1A).

Once the first side of the roll of tape 119 rests on the bearing shelf 208, a second side of the roll of tape 119 will be below the lip 220 located of each flexible member 215 thereby allowing the flexible members 215 to spring back into their resting positions (see, e.g., FIG. 3) resulting in a portion of the lips 220 of flexible members 215 overlapping a portion of the edge 117 of the roll of tape 119.

Figure 4:
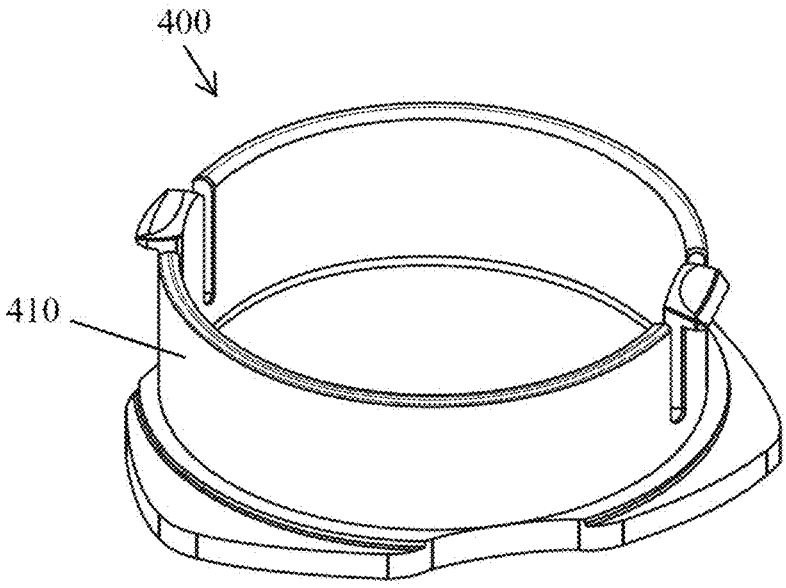
FIG. 4 illustrates yet another example implementation of a tape holder constructed in accordance with the present disclosure.

FIG. 4 illustrates yet another example implementation of the tape holder 400 of the present disclosure. In some implementations, the tape holder 400 is similar to the tape holders 100, 200 discussed above but with a shorter spool support 410.

Figure 5A:
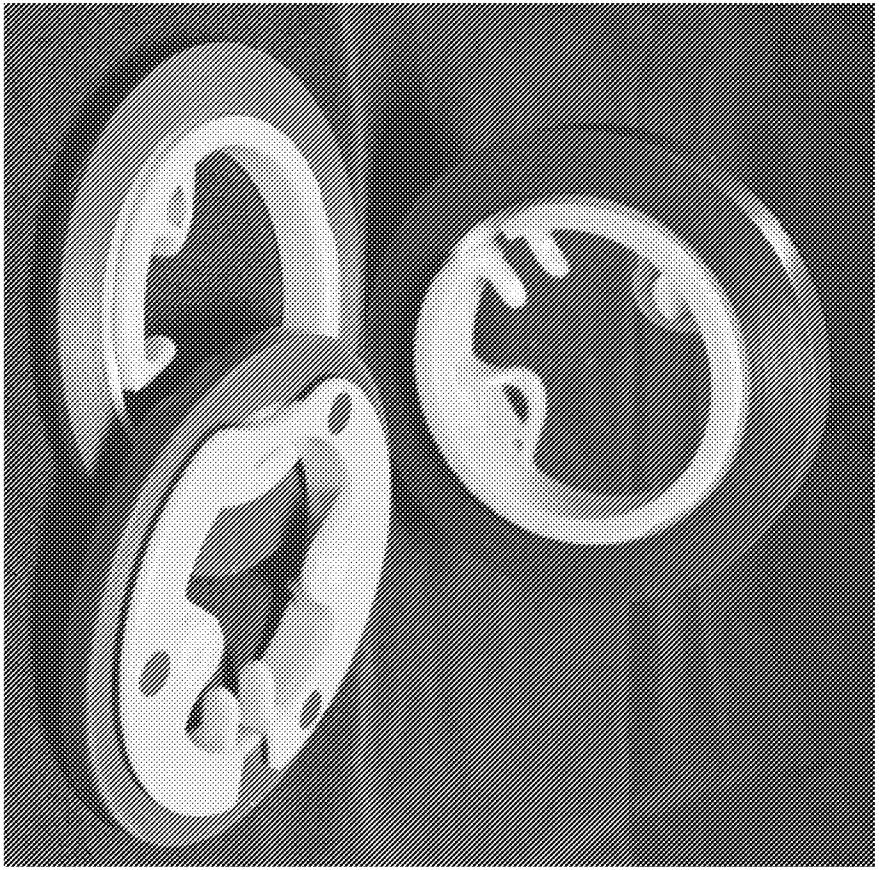
FIGS. 5A and 5B illustrate another example implementation of a tape holder constructed in accordance with the present disclosure.
Figure 5B:
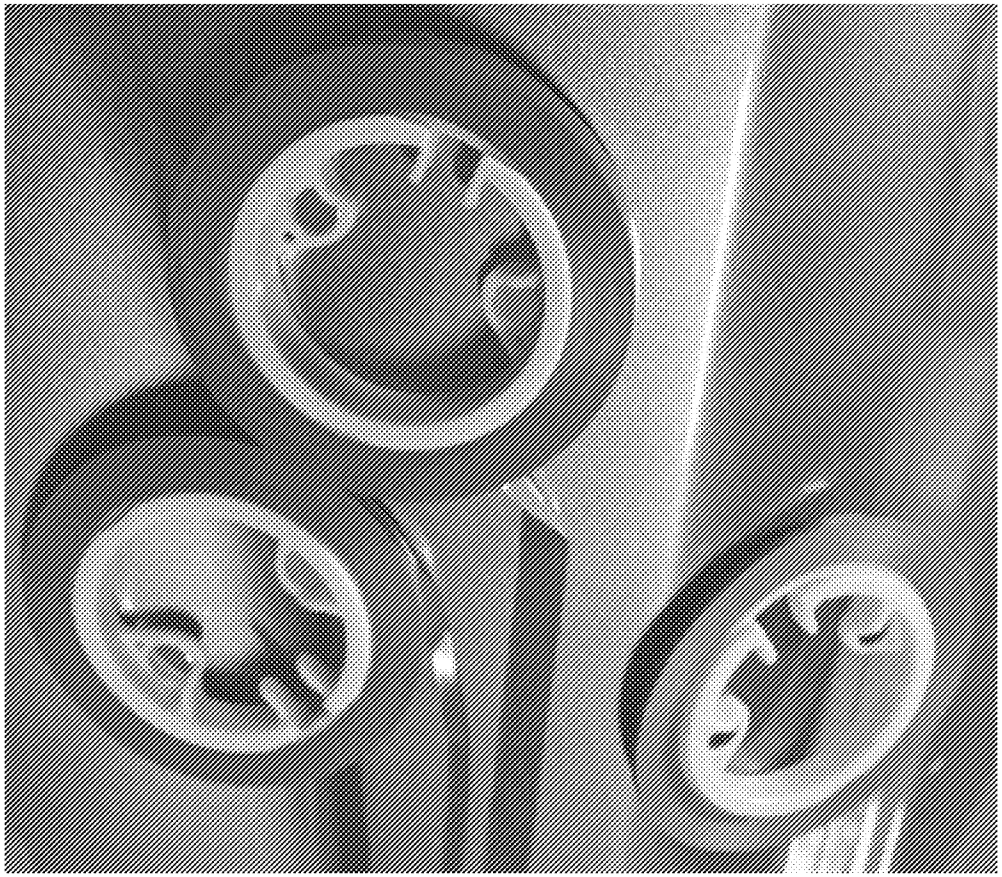

FIGS. 5A and 5B illustrate another example implementation of a tape holder constructed in accordance with the present disclosure.

Figure 6A:
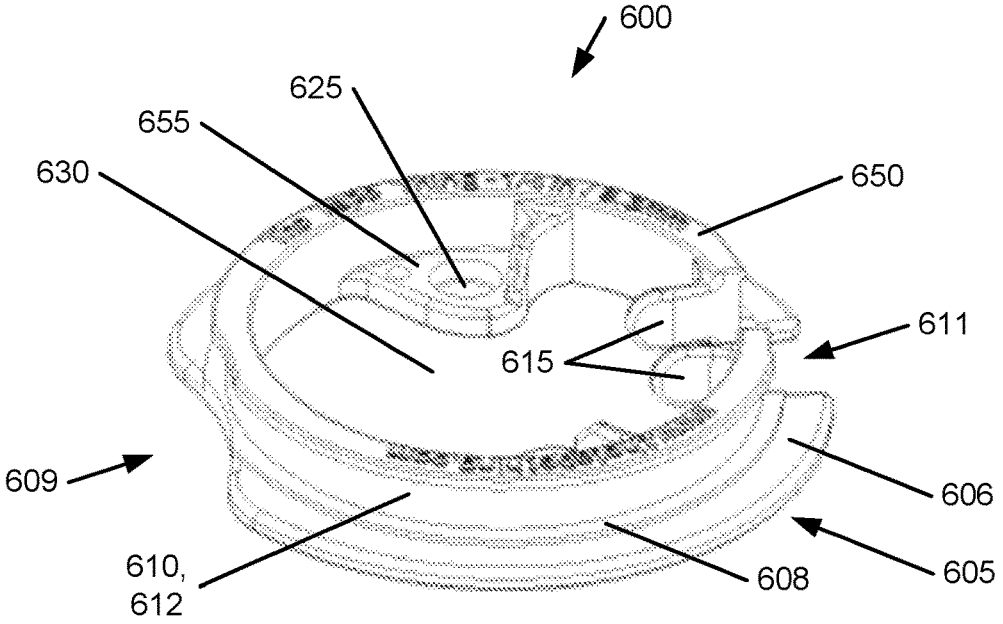
FIGS. 6A and 6B illustrate another example implementation of a tape holder constructed in accordance with the present disclosure.
Figure 6B:
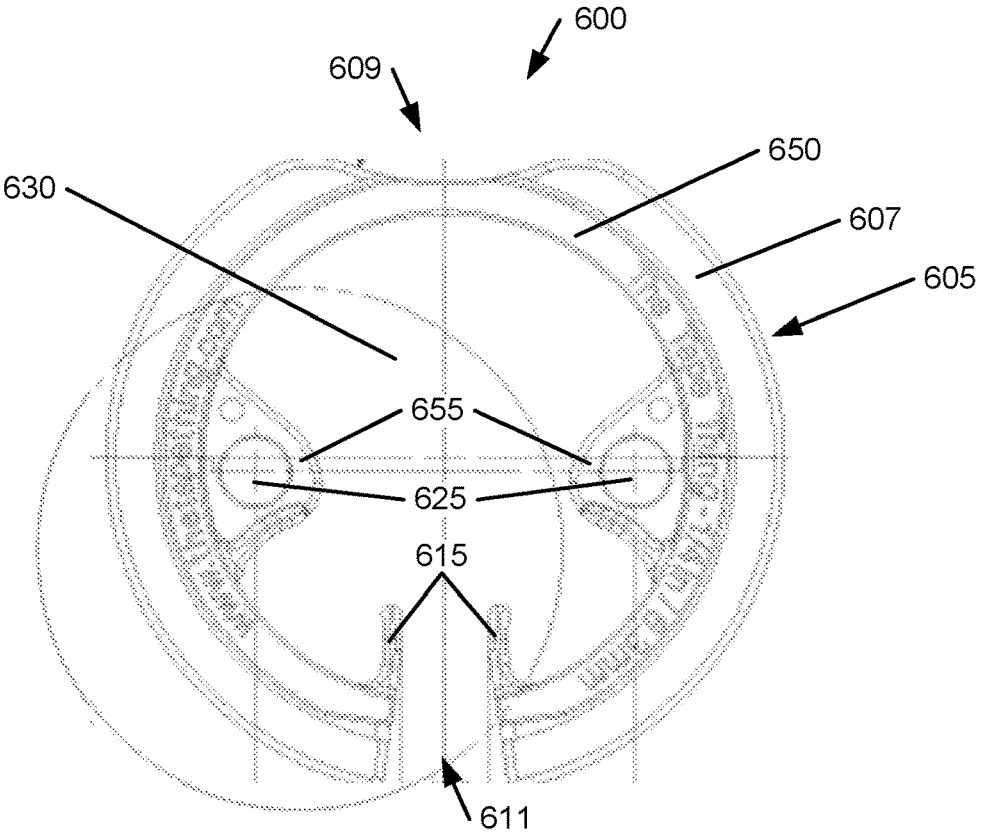

FIGS. 6A and 6B illustrate another example tape holder 600 for securing a roll of tape to a surface according to the present disclosure, such as the example tape holder shown in FIGS. 5A and 5B.

In some implementations, the tape holder 600 is similar to and functions similar to the tape holder discussed above, except as described below. In some implementations, the tape holder 600 does not include the flexible members 215. In some implementations, the tape holder 600 further includes a top bearing shelf 650, tabs 615, and protrusion 655. Also, in some implementations, the base 605 does not include magnets.

As shown in FIGS. 6A and 6B, in some implementations, the tape holder 600 comprises a base member 605 and a spool support 610. In some implementations, the spool support 610 is configured to secure a roll of tape to the tape holder 600.

In some implementations, the tape holder 600 is constructed with an opening 630 extending through a portion of the base member 605 and the spool support 610.

As shown in FIG. 6B, in some implementations, the base member 605 may be flat and have a generally circular shape. In some implementations, the base member 605 may be any other suitable shape.

In some implementations, the spool support 610 may be defined by a wall 612 having a circular shape.

In some implementations, one side of the spool support 610 may be attached to the base member 605. As shown in FIG. 6A, in some implementations, the diameter of the base member 605 as measured from the center of the tape holder 600 is larger than the diameter of the spool support 610. In this way, when the spool support 610 rest on top of the base member 605, a portion of the base member 605 extends from the spool support 610 thereby creating a ledge around the tape holder 600. In some implementations, the spool support 610 may be integrally formed as part of the base member 605. In some implementations, the spool support 610 may be removably attached to the base member 605.

In some implementations, the bearing shelf 608 may be positioned above the base member 605. In some implementations, the bearing shelf 608 may extend from the spool support 610 thereby creating a ledge around the spool support 610 to support a roll of tape. In some implementations, the bearing shelf 608 may be circular. In some implementations, the bearing shelf 608 may be any suitable shape.

In some implementations, the top bearing shelf 650 extends from the top end of the spool support 610 thereby creating another ledge around the spool support 610.

In some implementations, the wall 612 of the spool support 610 may be configured to allow a roll of tape to rotate smoothly thereabout. In some implementations, the wall 612 of the spool support 610 may be configured to restrict the rotation of a roll of tape.

In some implementations, the spool support 610, base member 605, and bearing shelves 608, 650 may include a cutout 611 extending therethrough.

In some implementations, the tabs 615 extend from the cutout 611 to the opening 630.

The tape holder 600 further comprises one or more protrusions 655 extending from the inner surface of the spool support 610 toward the opening 630. In some implementations, at least a portion of the protrusions 655 are magnetic. In some implementations, the protrusions 655 include one or more recesses 625 configured to receive and hold a magnet.

In some implementations, the base member 605 has one or more magnets on one side for securing the tape holder 600 to a surface.

In some implementations, the base member 605 may have a top side 607 and a bottom side 606. In some implementations, the top side 607 of the base member 605 may include one or more recesses 625 thereon to receive a magnet therein. In some implementations, the top side 607 may include two recesses as shown in FIG. 6B. In some implementations, the top side 607 may include more than two recesses 625 thereon.

In some implementations, a recess 625 is round. In some implementations, a recess 625 may be any suitable shape. In some implementations, an adhesive is used to secure a magnet into a recess 625. In some implementations, any suitable means may be used to secure a magnet within a recess 625. In some implementations, the magnets can be covered with an anti-skid material. In some implementations, the magnets can be located within the interior of the base member 605.

To insert a roll of tape on the tape holder 600, the tabs 615 are pressed towards each other to reduce the diameter of the tape holder 600 to receive the tape. Once the spool support 610 has received the tape, the tabs 615 may be released. The top bearing shelf 650 may help to secure the tape on the tape holder 600.

Figure 7:
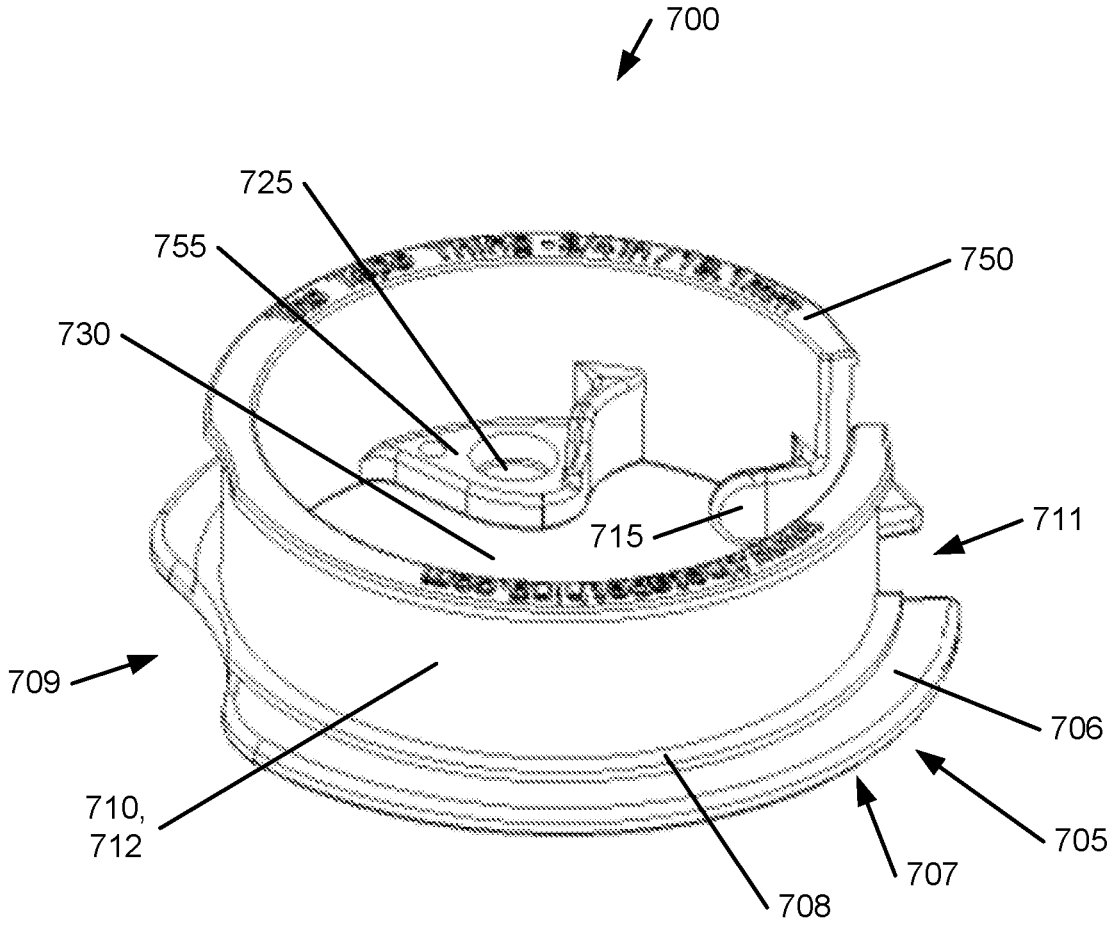
FIG. 7 illustrates yet another example implementation of a tape holder 700 constructed in accordance with the present disclosure.

FIG. 7 illustrates yet another example implementation of the tape holder 700 of the present disclosure. In some implementations, the tape holder 700 is similar to the tape holder 600 discussed above but with a longer spool support 710.

In some implementations, the spool support 610 may be approximately 0.75" tall. In some implementations, the spool support 610 may be approximately 1.485" tall. In some implementations, the spool support 610 may be shorter than 0.75" or taller than 1.485". In some implementations, the height of the spool support 610 may range between 0.75" and 1.485". In some implementations, the spool support 610 may be approximately 0.0625" tall. In some implementations, the spool support 610 may be approximately 0.125" tall. In some implementations, the spool support 610 may be approximately 0.25" tall. In some implementations, the spool support 610 may be approximately 0.5" tall. In some implementations, the height and diameter of the spool support 610 is configured to secure a roll of tape thereabout. In some implementations, the height of the spool support 610 is configured to secure one or more rolls of tape thereabout.

In some implementations, the tape holder 100, 200, 400, 600, 700 may be configured to receive a roll of masking tape. In some implementations, the tape holder 100, 200, 400, 600, 700 may be configured to receive any roll of tape having an interior opening.

To use the tape holder 100, 200, 400, 600, 700, the top side of the base member 105, 205, 405, 605, 705 where the magnets are located is oriented towards a suitable surface. The magnets hold the tape holder 100, 200, 400, 600, 700 to the selected surface and provide a shearable magnetic connection therewith. The tape holder 100, 200, 400, 600, 700 may then be oriented as desired by the user.

In some implementations, the tape holder 100, 200, 400, 600, 700 may be affixed to an automotive body. In some implementations, the tape holder 100, 200, 400, 600, 700 may be affixed to a tool belt. In some implementations, the tape holder 100, 200, 400, 600, 700 may be secured to any surface to which a shearable magnetic connection may be formed.

In some implementations, the tape holder 100, 200, 400, 600, 700 may be manufactured from a polymer. In some implementations, the tape holder 100, 200, 400, 600, 700 may be manufactured from a metal. In some implementations, the tape holder 100, 200, 400, 600, 700 may be manufactured from any suitable material.

Reference throughout this specification to "an embodiment" or "an implementation" or words of similar import means that a particular described feature, structure, or characteristic is included in at least one embodiment of the present invention. Thus, the phrase "in an embodiment" or "an implementation" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A tape holder comprising:

a spool support comprising a wall having a circular shape and configured to secure a roll of tape thereon, wherein the spool support includes an opening that extends therethrough;

a base member extending from the spool support thereby creating a ledge around the spool support wherein the base member includes one or more magnets;

a top bearing shelf extending from an end of the spool support opposite the base member thereby creating a top ledge around the spool support;

a bottom bearing shelf positioned above the base member and extending from the spool support thereby creating a bottom ledge around the spool support;

a cutout extending through the top bearing shelf, the spool support, the bottom bearing shelf, and the base member thereby defining an opening through the top bearing shelf, the spool support, the bottom bearing shelf, and the base member; and a pair of tabs extending from both sides of the cutout respectively towards the opening.

2. The tape holder of claim 1 wherein the bottom bearing shelf is configured such that the bottom edge of the roll of tape when secured about the spool support rests on the bottom ledge, and wherein the top bearing shelf is configured such that the top ledge secures the roll of tape about the spool support from the opposite top edge of the roll of tape.

3. The tape holder of claim 1 wherein the base member comprises one or more base member cut-outs.

4. The tape holder of claim 3 wherein the one or more base member cut-outs are sized to extend under at least a portion of the roll of tape when secured about the spool support.

5. The tape holder of claim 1 further comprising one or more protrusions extending from the wall into the opening of the spool support.

6. The tape holder of claim 5 wherein the one or more protrusions comprise one or more magnets configured to magnetically secure the tape holder to a surface adjacent to the base member.

7. The tape holder of claim 1 wherein at least one of the base member, the top bearing shelf, or the bottom bearing shelf is circular.

8. A method of securing tape to the tape holder of claim 1 comprising:

pressing the tabs toward each other and thereby reducing the diameter of the spool support to receive the roll of tape thereabout;

inserting the spool support into the interior of the roll of tape and positioning the roll of tape about the spool support;

releasing the tabs to secure the roll of tape about the spool support; and positioning and magnetically securing the tape holder to a surface adjacent to the base member.

9. A tape holder comprising:

a spool support comprising a wall having a circular shape and configured to secure a roll of tape thereon, wherein the spool support includes an opening that extends therethrough;

a base member extending from the spool support thereby creating a ledge around the spool support;

a top bearing shelf extending from an end of the spool support opposite the base member thereby creating a top ledge around the spool support;

a bottom bearing shelf positioned above the base member and extending from the spool support thereby creating a bottom ledge around the spool support;

a cutout extending through the top bearing shelf, the spool support, the bottom bearing shelf, and the base member thereby defining an opening through the top bearing shelf, the spool support, the bottom bearing shelf, and the base member;

a pair of tabs extending from both sides of the cutout respectively towards the opening of the spool support; and one or more protrusions extending from the wall into the opening of the spool support, wherein the one or more protrusions comprise one or more magnets configured to magnetically secure the tape holder to a surface adjacent to the base member.

10. The tape holder of claim 9 wherein the bottom bearing shelf is configured such that the bottom edge of the roll of tape when secured about the spool support rests on the bottom ledge, and wherein the top bearing shelf is configured such that the top ledge secures the roll of tape about the spool support from the opposite top edge of the roll of tape.

11. The tape holder of claim 9 wherein the base member comprises one or more base member cut-outs.

12. The tape holder of claim 11 wherein the one or more base member cut-outs are sized to extend under at least a portion of the roll of tape when secured about the spool support.

13. The tape holder of claim 9 wherein the base member comprises one or more magnets configured to magnetically secure the tape holder to the surface adjacent to the base member.

14. The tape holder of claim 9 wherein at least one of the base member, the top bearing shelf, or the bottom bearing shelf is circular.

15. A method of securing tape to the tape holder of claim 9 comprising:

pressing the tabs toward each other and thereby reducing the diameter of the spool support to receive the roll of tape thereabout;

inserting the spool support into the interior of the roll of tape and positioning the roll of tape about the spool support;

releasing the tabs to secure the roll of tape about the spool support; and positioning and magnetically securing the tape holder to the surface adjacent to the base member.

* * * * *